US006390434B1

(12) United States Patent
Tan

(10) Patent No.: US 6,390,434 B1
(45) Date of Patent: May 21, 2002

(54) MAGNETIC NOTE PAPER HOLDER

(76) Inventor: Chin-Jen Tan, P.O. Box 55-175, Taichung (TW)

( * ) Notice: Subject to any disclaimer, the term of this patent is extended or adjusted under 35 U.S.C. 154(b) by 0 days.

(21) Appl. No.: 09/482,345

(22) Filed: Jan. 14, 2000

(51) Int. Cl.[7] ..... A47B 97/00

(52) U.S. Cl. ..... 248/504; 248/683; 248/206.5; 248/309.4; 281/DIG. 1

(58) Field of Search ..... 248/504, 683, 248/441.1, 206.5, 207, 309.4; 281/45, DIG. 1

(56) References Cited

U.S. PATENT DOCUMENTS 2,510,634 A * 6/1950 Hull ..... 175/367
D307,745 S * 5/1990 Adams ..... D13/99
5,842,721 A * 12/1998 Kawabe ..... 281/45
5,895,018 A * 4/1999 Rielo ..... 248/206.5
5,996,821 A * 12/1999 Farber et al. ..... 211/89.01
6,145,799 A * 11/2000 Khon ..... 248/442.2

* cited by examiner

*Primary Examiner*—Ramon O. Ramirez
*Assistant Examiner*—A. Joseph Wujciak

(57) ABSTRACT

The present invention provides a magnetic note paper holder comprising a seat and a movable pressing component wherein the top edge of the seat and the bottom edge of the movable pressing component are built in with one magnet respectively, and the magnetic polarities of the surfaces of the magnets are of opposite polarities so as to fix the movable pressing component to hold the paper from opposite sides, and wherein at least one end of one magnet is shaped to be a convex spherical arc and the end of the arc and the other magnet attract each other such that a point contact is formed to weaken the friction, therefore, providing convenience for drawing out the piece of paper.

5 Claims, 3 Drawing Sheets

MAGNETIC NOTE PAPER HOLDER

BACKGROUND OF THE INVENTION

The present invention is related to a paper holder such as note paper, member card, etc., and more particularly to a magnetic note paper holder for holding sheets of paper between two magnets that attract each other, whereby sheets of paper are firmly placed and taken out more conveniently and easily.

Traditionally, various paperweights are used for putting on the surface of paper to keep the paper firmly placed to avoid scattering. As far as traditional paperweight is concerned, it requires a substantial weight in order to produce necessary stability, and requires a big base area in order to press more paper. However, as to the paper of small area such as note paper and various tickets (e.g. toll fare receipt), the area of paperweight is much too large for them. It is not easy to know whether there is paper under the paperweight and therefore causes inconvenience. Furthermore, when the paperweight is put on top of the paper, the contact area between the paperweight and paper is wide and in addition to the substantial weight of the paperweight, it is difficult for us to take out the paper, and instead, it is necessary to remove the paperweight beforehand. Apparently, it constitutes convenience in taking paper out of the paperweight. Thus a magnetic note paper holder is invented.

Please refer to FIG. 1. The magnetic note paper holder consists of a magnetic seat 1 and an iron ball 2 wherein the magnetic seat 1 is made of magnet, of which the top is a plane surface. The iron ball 2 is placed on the top surface of the seat 1 and attracted by the seat 1. In practice, the note paper holder is installed between the iron ball 2 and the seat 1, sheets of paper are clipped by making use of the weight of iron ball and the magnetic attraction force applied to the iron ball by the seat 1. Although the magnetic note paper holder can have the paper positioned, it can not be used in any non-plane surface but only on a table surface because the iron ball 2 is apt to roll down to low place thus it is not able to be fixed at a position if the magnetic seat 1 is placed on a declined surface (e.g. in a car), hence the place for use is limited. Furthermore, upon taking out the note paper, the iron ball 2 would easily roll over due to the relative friction between the sheet of paper and the iron ball 2, and wherever the iron ball 2 rolls, it is abstracted at any spot and does not return back to normal place because of the magnetic force of every spot of the magnetic seat 1 applied to the iron ball 2. Later on the iron ball 2 would roll over the magnetic seat 1 and fall down. In the meantime, it is difficult to add decorations to the iron ball 2 due to that it rolls easily; its productive value is then limited.

SUMMARY OF THE PRESENT INVENTION

The maim purpose of the invention is to provide a magnetic note paper holder, which holds paper between two magnets abstracting each other, and wherein at least one magnet has a spherical arc at its top edge and opposite to another magnet so that the magnetic force can be concentrated to increase the density of magnetic force in the central part, thus it is convenient to take out the note paper and able to keep the paper firmly.

Another purpose of the invention is to provide a magnetic note paper holder, which presses the paper in a manner of point contact by using a movable pressing component to allow the paper to interact the movable pressing component to rotate and swing. According to the present invention, the vertical magnetic note paper holder consists of a seat and a movable pressing component, wherein one magnet is set in the top of the seat and the bottom of the movable pressing component respectively, and said magnets are set in opposite position. The magnetic polarities of the opposite surfaces of the two magnets are opposite so as to fix the movable pressing component at the top of the seat and allow the pressing component to be able to hold the paper oppositely; and at least one surface of an end is shaped to be a convex spherical arc, of which the end of the arc abstracts another magnet oppositely to form a point contact such that the friction is weakened.

DETAILED DESCRIPTION OF THE PREFERRED EMBODIMENT

Figure 1:
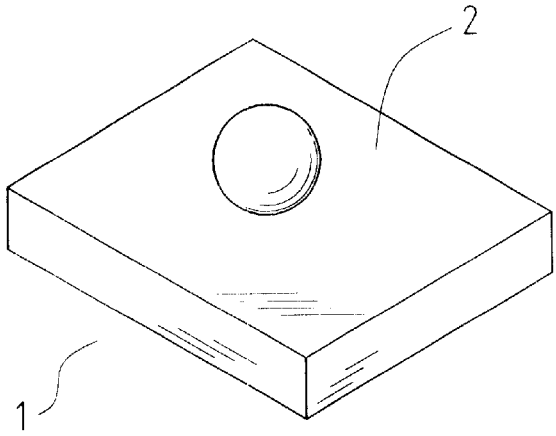
FIG. 1 PRIOR ART
FIG. 1 is an elevated schematic view of the prior art.
Figure 2:
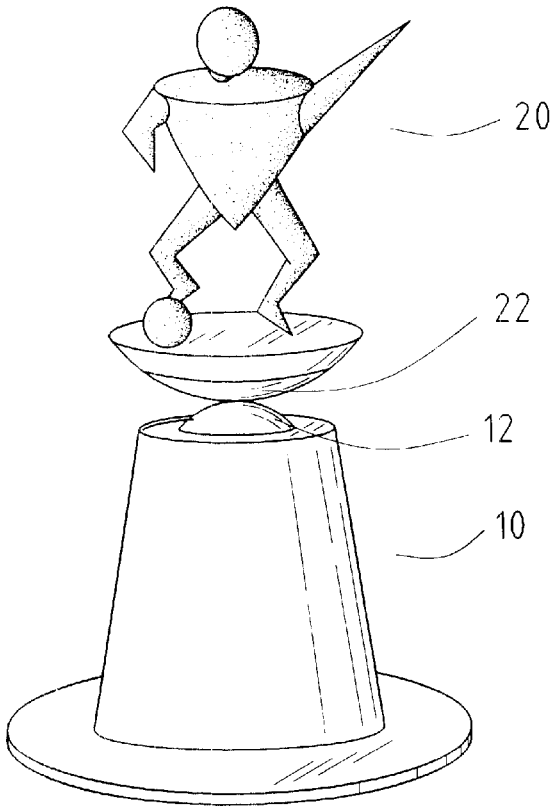
FIG. 2 is an elevated view to show the first preferred embodiment of the present invention.

Please refer to FIG. 2, the first preferred embodiment of the present invention of a magnetic note paper holder which general comprising a seat 10 and a movable pressing component 20 wherein the seat 10 is built in with a first magnet 12 at its top end and the pressing component 20 is built in with a second magnet 22 at its bottom. The first and second magnets 12 and 22 are placed in an opposite position, and the magnetic polarities of the opposite surfaces of the first and second magnets are opposite. The abstraction between the first and second magnets 12 and 22 fixes the movable pressing component 20 on the top of the seat 10 to allow the seat 10 and the pressing component to hold the paper at opposite sides; Furthermore, the edge of the top of the first magnet 12 is shaped to be a convex spherical arc and projects from the edge of the top of the seat 10, and the edge of the bottom of the second magnet 22 is also shaped to be a convex spherical arc and projects from the edge of the bottom of the movable pressing component 20 such that it is more convenient to draw out the piece of paper and keep the pieces of paper firmly.

Figure 3:
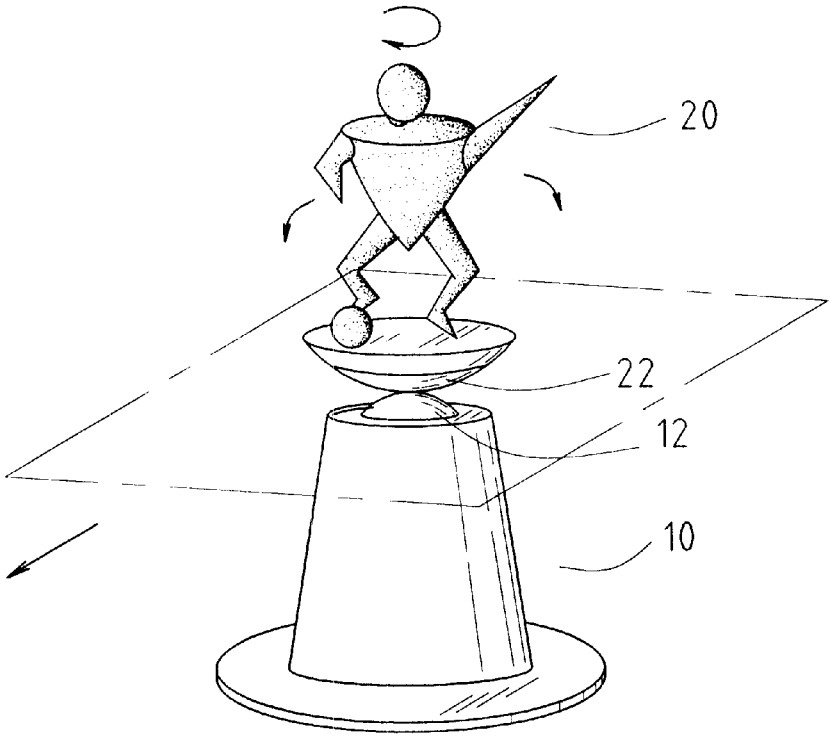
FIG. 3 is a schematic view showing the use of the first preferred embodiment of he present invention.

Please refer to FIG. 3. When using said first preferred embodiment, the movable pressing component 20 can be taken off from the seat 10. The paper is then put on the top edge of the seat 10, then put back the movable pressing component 20 to the top of the seat 10. By making use of the characteristic that the magnetic force can penetrate through the paper, the first and second magnets 12 and 22 attract each other, and fix the movable pressing component 20 on the top of the seat 10. The two magnets hold up the paper at both sides. As the edges of the first and second magnets 12 and 22 are of spherical ball arc shape; they are in point contact with the paper, and as the magnetic force between the first and second magnets 12 and 22 is concentrated in the area adjacent to the central part of the edged surface of the spherical arc such that the paper is easily drawn out directly.

The area having bigger magnetic force density has bigger attracting force, therefore, the movable pressing component 20 remains on the top of the seat 10 due to the attraction of the magnetic force. The paper can be taken out with no need to take off the movable pressing component 20 thus it increases the convenience of the drawing of the paper. It is to be noted that when drawing the paper, the second magnet 22 activates the movable pressing component 20 to rotate and swing, which is caused by the friction of the opposite surfaces of the paper and the second magnet 22. The rotation and swinging motion make the device a tumbler, which increases the significant additional value of the device.

Figure 4:
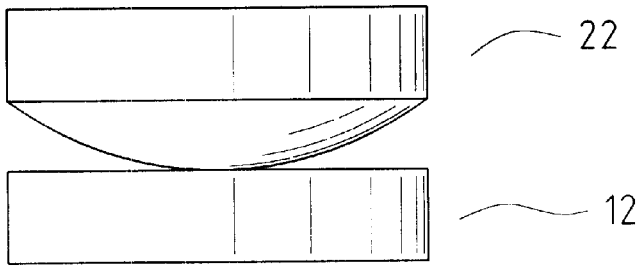
FIG. 4 is a side view to show the first and second magnets of the second preferred embodiment of the present invention.
Figure 5:
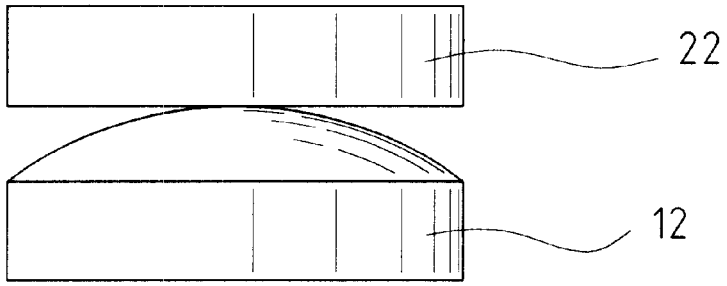
FIG. 5 is a side view to show the first and second magnets of the third preferred embodiment of the sent invention.

In addition, the first preferred embodiment of the present invention may further be changed to other embodiments. Please refer to FIG. 4, which shows the second preferred embodiment, wherein the edge of the top of the first magnet 12 is a plane surface and the edge of the second magnet 22 is a spherical arc so that they can meet the predetermined purpose. Please refer to FIG. 5 which shows the third preferred embodiment of the present invention wherein the edge of the top surface of the first magnet 12 is of a spherical arc and the bottom of the second magnet 22 is a plane surface so that they can meet the predetermined purpose.

Figure 6:
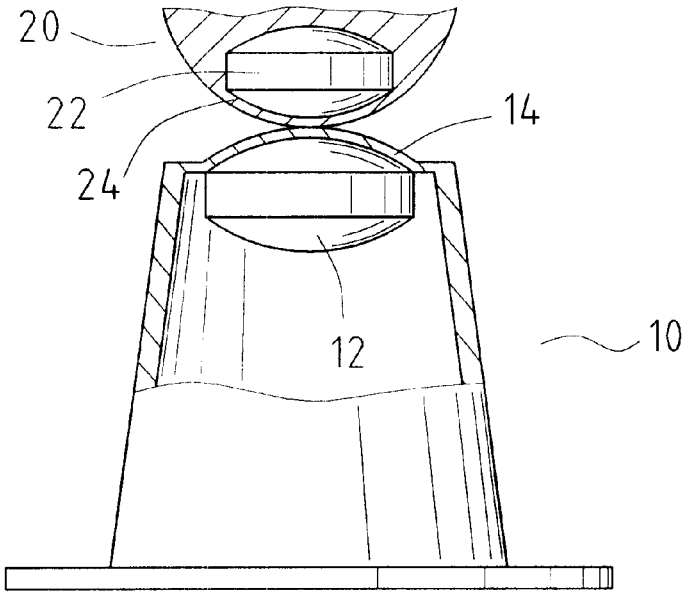
FIG. 6 is a partial sectional schematic view to show the fourth preferred embodiment of the invention.

Further refer to FIG. 6. The first preferred embodiment of the present invention is modified slightly to be the fourth preferred embodiment wherein the first magnet 12 is embedded inside the top edge of the seat 10, and the seat 10 connects with the first magnet 12 and with a top cap 14 of shell type so as to embed the first magnet 12 and the second magnet 22 together into the bottom of the movable pressing component 20. The movable pressing component 20 together with the second magnet 22 is covered with a lower cap 24 of thin shell type so as to seal the second magnet 22 to protect the first and second magnets 12 and 22 to extend their life. Furthermore, as the bottom edge of the first magnet 12 is a convex spherical arc surface and the top edge of the second magnet 22 is also a convex spherical arc surface, the attraction force between the first and the second magnets 12 and 22 is increased.

While the invention herein disclosed has been described by means of specific embodiments, numerous modifications and variations could be made thereto by those skilled in the art without departing from the scope of the invention set forth in the claims.

What is claimed is:

1. A magnetic note paper holder comprising:

a seat and a movable pressing component wherein a top of the seat and a bottom of the movable pressing component are provided with a magnet respectively, and polarities of opposite surfaces of the magnets of the seat and the movable pressing component are opposite so as to fix the magnet on the bottom of the movable pressing component on the magnet on the top of the seat so that a paper sheet is held between the magnet on the bottom of the movable pressing component and the magnet on the top of the seat in a horizontal manner; and at least one end of one magnet is shaped to be a convex spherical arc, and one end of the spherical arc of the one magnet is in magnetic contact with the other magnet;

wherein, the opposite surfaces of the magnets of the seat and the movable pressing component are shaped to be a convex spherical arc so as to provide with convenience for drawing papers.

2. A magnetic note paper holder as recited in claim 1, wherein both ends of each magnet are shaped to be a convex spherical arc to increase the attraction force between the magnets.

3. A magnetic note paper holder as recited in claim 1, wherein the thin shell type sealing caps are respectively provided on the top of the seat and at the bottom of the movable pressing component in adaption to the respective magnet so as to seal each magnet on the seat and the movable pressing component to protect each of the magnets and extend their lives.

4. A magnetic note paper holder as recited in claim 1, wherein the magnet built in the seat is the first magnet and the magnet built in the movable pressing component is the second magnet; the top edge of the first magnet is shaped to be a plane surface and the bottom edge of the second magnet is shaped to be a convex spherical arc.

5. A magnetic note paper holder as recited in claim 1, wherein the magnet built in the seat is the first magnet and the magnet built in the movable pressing component is the second magnet; the bottom edge of the second magnet is shaped to be a plane surface and the top edge of the first magnet is shaped to be a convex spherical arc.

* * * * *